US005943083A

United States Patent [19]

Defieuw

[11] Patent Number: 5,943,083

[45] Date of Patent: Aug. 24, 1999

[54] ASSEMBLY COMPRISING A PLURALITY OF THERMAL HEADS

[75] Inventor: Geert Defieuw, Bonheiden, Belgium

[73] Assignee: Agfa-Gevaert N.V., Mortsel, Belgium

[21] Appl. No.: 08/990,950

[22] Filed: Dec. 15, 1997

[30] Foreign Application Priority Data

Dec. 16, 1996 [EP] European Pat. Off. ..... 96203557

[51] Int. Cl.[6] ..... B41J 2/335

[52] U.S. Cl. ..... 347/171; 347/200

[58] Field of Search ..... 347/200, 171; 400/82

[56] References Cited

U.S. PATENT DOCUMENTS

| | | | |
|---|---|---|---|
| 4,606,267 | 8/1986 | Wessel et al. | 101/93.04 |
| 4,626,870 | 12/1986 | Yamamoto et al. | 346/76 |
| 4,660,052 | 4/1987 | Kaiya et al. | 347/200 |
| 4,977,410 | 12/1990 | Onuki et al. | 346/76 |
| 5,229,788 | 7/1993 | Shimada et al. . | |
| 5,367,321 | 11/1994 | Shigenori et al. | 347/200 |

FOREIGN PATENT DOCUMENTS

| | | |
|---|---|---|
| 0378291 | 7/1990 | European Pat. Off. . |
| 58-134766 | 8/1983 | Japan . |
| 59-232881 | 12/1984 | Japan . |
| 63-166428 | 10/1988 | Japan . |

*Primary Examiner*—Huan Tran
*Attorney, Agent, or Firm*—Baker & Botts, L.L.P.

[57] ABSTRACT

An assembly comprising a plurality of thermal heads (10), each thermal head comprising a linear array of resistor elements mounted on a flat substrate (17), and a drum (15) of diameter D mm for supporting a thermographic recording material, said thermal heads being mounted in a staggered fashion in at least two parallel rows (11,12) in which the linear arrays of resistor elements are parallel to one another, characterized in that:

i) said resistor arrays of adjacent rows of thermal heads are separated by a spacing, d, greater than 0.2 mm; and ii) said substrates of thermal heads in adjacent rows (17', 17") include an angle Θ comprised between arc sine (d/2D) and arc sine (2d/D);

and a direct thermal printing process therewith.

10 Claims, 2 Drawing Sheets

ASSEMBLY COMPRISING A PLURALITY OF THERMAL HEADS

FIELD OF THE INVENTION

The present invention relates to an assembly comprising a plurality of thermal heads suitable for image-wise heating of thermographic materials.

BACKGROUND OF THE INVENTION

Thermal imaging or thermography is a recording process wherein images are generated by the use of imagewise modulated thermal energy.

In thermography three approaches are known:

1. Thermal dye transfer printing wherein a visible image pattern is formed by transfer of a coloured species from an image-wise heated donor element onto a receptor element;

2. Image-wise transfer of an ingredient necessary for the chemical or physical process bringing about changes in colour or optical density to a receptor element; and 3. Direct thermal formation of a visible image pattern by image-wise heating of a recording material containing matter that by chemical or physical process changes colour or optical density.

A survey of thermographic processes is given e.g. in the book "Unconventional Imaging Processes" by E. Brinckman, G. Delzenne, A. Poot and J. Willems, The Focal Press—London and New York (1978), Chapter 4 under the heading "4.10 Thermography".

Thermal dye transfer printing is a recording method wherein a dye-donor element is used that is provided with a dye layer wherefrom dyed portions or incorporated dyes are transferred onto a contacting receiver element by the application of heat in a pattern normally controlled by electronic information signals. Thermal dye transfer printing materials are described, for example, in EP-B 133 012 and EP-A 133 011.

Processes in which image formation is obtained by the image-wise transfer of an ingredient necessary for the chemical or physical process bringing about changes in colour or optical density to a receptor element are, for example, described in EP-A 671 283 in which a thermographic process is provided using (i) a reductor donor element comprising on a support a donor layer containing a binder and a thermotransferable reducing agent capable of reducing a silver source to metallic silver upon heating and (ii) a receiving element comprising on a support a receiving layer comprising a silver source capable of being reduced by means of heat in the presence of a reducing agent, the thermographic process comprising the steps of bringing the donor layer of the reductor donor element into face to face relationship with the receiving layer of the receiving element, image-wise heating a thus obtained assemblage by means of a thermal head, thereby causing image-wise transfer of an amount of the thermotransferable reducing agent to the receiving element in accordance with the amount of heat supplied by the thermal head and separating the donor element from the receiving element.

This printing method is further referred to as 'reducing agent transfer printing' or 'RTP'. Materials for such processes are, for example, described in EP-A's 671 283, 671 284, 674 216, 677 775, 677 776, 678 775, 682 438, 683 428 and 706 080.

Direct thermal thermography is concerned with materials which are substantially not photosensitive, but are sensitive to heat or thermosensitive. Imagewise applied heat is sufficient to bring about a visible change in a thermosensitive imaging material. Most of the "direct" thermographic recording materials are of the chemical type. On heating to a certain conversion temperature, an irreversible chemical reaction takes place and a coloured image is produced. This irreversible reaction can be, for example, the reaction of a leucobase with an acid to produce the corresponding dye or the reduction of an organic or inorganic metal compound (e.g. silver, gold, copper or iron compounds) to its corresponding metal thereby producing a visible image. Such imaging materials are described, for example, in U.S. Pat. No. 3,080,254, EP-B 614 770, EP-B 614 769, EP-A 685 760, U.S. Pat. No. 5,527,757, EP-A 680 833, U.S. Pat. No. 5,536,696, EP-B 669 876, EP-A 692 391, U.S. Pat. No. 5,527,758, EP-A 692 733, U.S. Pat. No. 5,547,914, EP-A 730 196 and EP-A 704 318.

The ensuring of constant print quality with all these imaging materials over the whole material width when wide format printers are used places considerable demands upon the thermal head. Thermal heads with lengths greater than 30.5 cm (12 inches), typically 61.0 cm (24 inches) or 91.4 cm (36 inches), are difficult to produce with a single ceramic substrate. This is particularly the case for thin film thermal heads. It is therefore necessary to produce such long thermal heads by mutually joining, i.e. butting, a plurality of shorter thermal heads.

If these shorter thermal heads are placed in line the unprinted areas between the ends of butting thermal heads are so large that white-out (no image formation) is observed in the printed images. However, if these shorter heads are displaced laterally parallel to one another and the ends of the heads positioned so that no whiteout occurs, the degree of contact between the thermal head and the recording material varies along the length of the head leading to print density, image hue variations and even pinholes in the image.

Furthermore, in the case of thermographic recording materials on the basis of silver behenate with reducing agents such as 3,4-dihydroxybenzoic acid esters, as disclosed in EP-A 692 733, or gallic acid esters, which upon imagewise heating with a thermal head exhibit excellent image tone, non-uniform thermal contact during imagewise heating leads to pinholes in those parts of the resulting image corresponding to poorer thermal contact. These pinholes are probably due to carbon dioxide formation during the image-forming process, owing to the lower temperature attained by the thermographic recording materials under such conditions.

A solution for the problem of non-uniform thermal contact has been proposed in U.S. Pat. No. 5,367,321, which discloses a plurality of rows of heating resistance elements each of the rows being linearly disposed on an associated heat reserve layer wherein adjacent two of the heat reserve layers have cross-sections overlapping with each other, and adjacent two of the rows of the linear heating resistance elements on the two reserve layers are deviated from each other by a distance ranging from 0.2 to 1.5 mm in a subscanning direction perpendicular to the principal scanning direction.

This solution solves the problem when the thermographic recording material support is flat, but, for reasons of thermal development module compactness, a thermal development module is usually designed with a drum to support the thermographic recording material. When the thermographic recording material is drum-supported, this solution results in variation in print density, variation in image tone and even in pinholes in the image, which become worse when the diameter of the drum support is reduced and hence as the compactness of the thermal development module is increased.

There is therefore a need for an assembly comprising a plurality of thermal heads for wide format printing which provides uniform print density and uniform image hue without pinholes for use with a thermographic recording material supported on a drum, thereby enabling compact thermal development assemblies to be developed for wide format printers.

OBJECT OF THE INVENTION

It is therefore an object of the invention to provide an assembly comprising a plurality of thermal heads for wide format printers for use with a thermographic recording material supported on a drum which provides prints without image defects where thermal heads butt with one another.

It is therefore a further object of the invention to provide an assembly comprising a plurality of thermal heads for wide format printers for use with a thermographic recording material supported on a drum which provides uniform print density.

It is therefore a further object of the invention to provide an assembly comprising a plurality of thermal heads for wide format printers for use with a thermographic recording material supported on a drum which provides uniform image hue.

It is therefore a still further object of the invention to provide an assembly comprising a plurality of thermal heads for wide format printers for use with a thermographic recording material supported on a drum which provides prints without pinholes.

Further objects and advantages of the invention will become apparent from the description hereinafter.

SUMMARY OF THE INVENTION

The above mentioned object is realised by an assembly comprising a plurality of thermal heads, each thermal head comprising a linear array of resistor elements mounted on a flat substrate, and a drum of diameter D mm for supporting a thermographic recording material, said thermal heads being mounted in a staggered fashion in at least two parallel rows in which the linear arrays of resistor elements are parallel to one another, wherein:

i) said resistor arrays of adjacent rows of thermal heads are separated by a spacing, d, greater than 0.2 mm; and ii) said substrates of thermal heads in adjacent rows include an angle Θ comprised between arc sine (d/2D) and arc sine (2d/D).

A direct thermal printing process is also provided according to the present invention comprising the steps of: (i) feeding a thermographic recording material onto a drum (15) of diameter D mm; and (ii) image-wise heating said thermographic recording material using an assembly as described above.

In a preferred embodiment of the assembly, according to the present invention, the substrates of the rows of thermal heads are mounted on a common base, for example an aluminium heat sink.

In a further preferred embodiment of the assembly, according to the present invention, the radius of the drum passing through the array of resistor elements is normal to the substrate thereof.

Further preferred embodiments of the present invention are disclosed in the dependent claims.

DETAILED DESCRIPTION OF THE INVENTION

The invention is described hereinafter by way of an example with reference to the accompanying figures wherein.

Prior art Assembly Comprising a Plurality of Thermal Heads

Figure 1A:
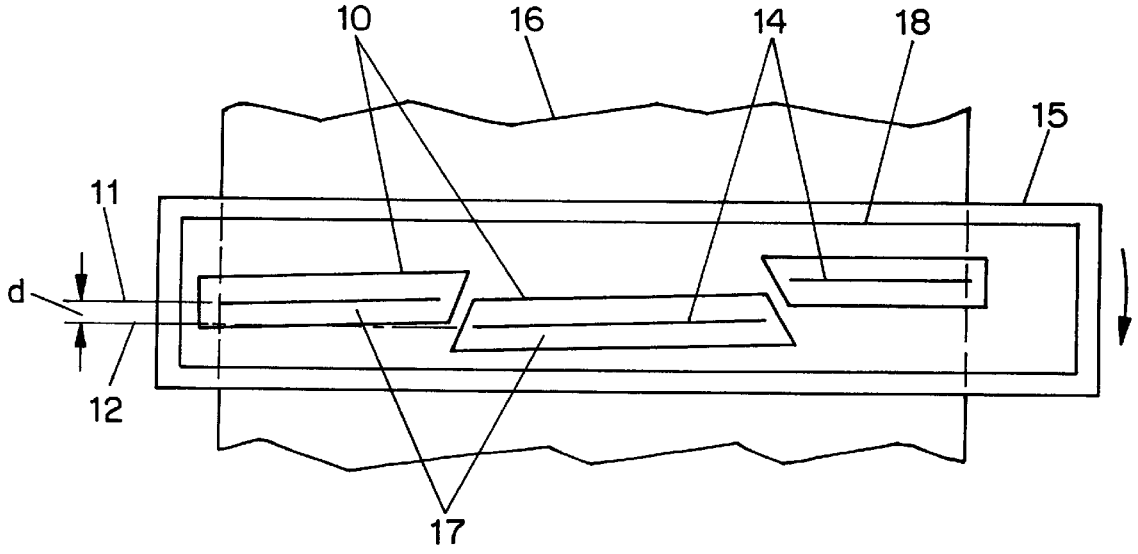
FIG. 1A (PRIOR ART)
FIG. 1A shows a top view of a prior art plurality of thermal heads for a wide format printer.
Figure 1B:
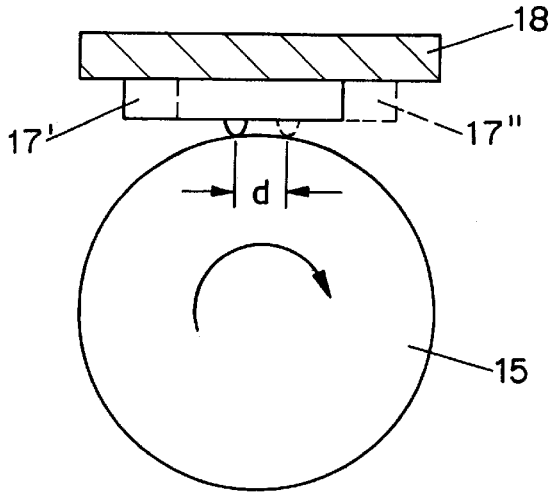
FIG. 1B (PRIOR ART)
FIG. 1B shows a side view of the prior art assembly comprising the plurality of thermal heads of FIG. 1*a*, from which the thermographic recording material has been omitted for the sake of clarity.

FIGS. 1*a* and 1*b* show a prior art assembly comprising a plurality of thermal heads according to U.S. Pat. No. 5,367,321 consisting, in the present example, of three elongate thermal heads 10, which are disposed in a staggered fashion in two parallel rows 11,12. Each head has a linear array 14 of a great plurality of heating resistor elements geometrically juxtaposed alongside one another in a bead-like row running parallel to the axis of the drum 15 supporting the thermographic recording material 16 to be printed. The linear arrays 14 of heating resistor elements are mounted on a flat substrate 17, e.g. in the form of a ceramic board, and the substrates are mounted on a common base 18, e.g. the bottom wall of an aluminium heat sink provided for cooling the plurality of thermal heads.

The thermographic recording material 16 may be in the form of a sheet fixedly attached to the drum 15 by means of clamps or the like in which case the drum 15 has a sufficiently large diameter to support the sheet of thermographic recording material. However, the thermographic recording material 16 either in the form of a sheet or a web may also be supported by the drum 15 over a limited angular area, for example less than 20 degrees in which case the drum may have a smaller diameter e.g. less than 40 mm.

The individual thermal heads may have an operating length of 12 inches, which would enable the prior art assembly comprising a plurality of thermal heads shown in FIG. 1*a* to cover a printing width of 36 inches. According to U.S. Pat. No. 5,367,321, the distances between the rows 11 and 12 measured in a plane parallel to that of the substrates, indicated by d in FIG. 1*b*, are 0.2 to 1.5 mm.

When such prior art assemblies comprising a plurality of thermal heads are used for the direct thermal printing of thermographic recording materials, it proved impossible to obtain a uniform print density and image hue without pinholes over the full width of the image, i.e. over the full length of the plurality of thermal heads in the assembly.

Assemblies Comprising a Plurality of Thermal Heads of the Present Invention

Thermal heads, according to the present invention, are elongate and comprise a linear array of resistors 14', 14"

mounted on a flat substrate 17', 17", which itself may be mounted on a cooling plates made of aluminium or other metallic material. Furthermore, the linear array of resistors may be covered with a protective layer.

Figure 2:
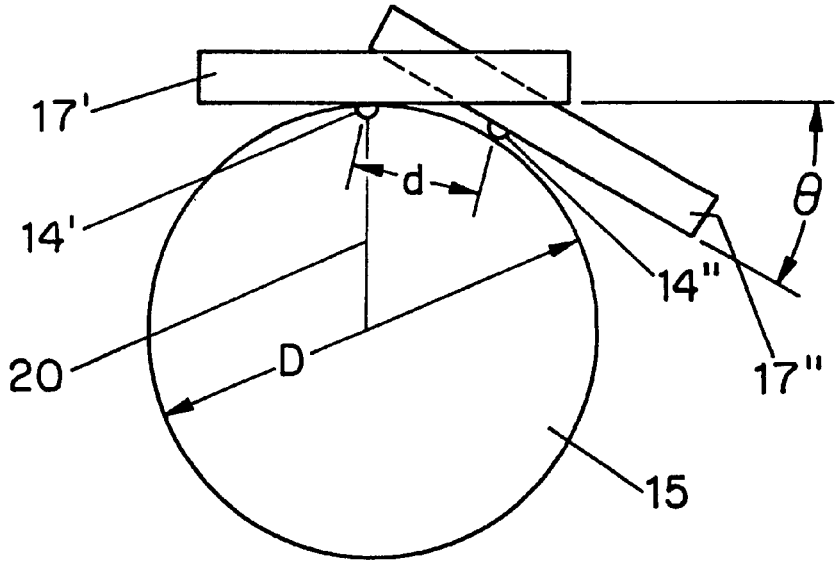
FIG. 2 shows a side view of one embodiment of an assembly comprising a plurality of thermal heads for a wide format printer according to the present invention, from which the thermographic recording material has been omitted for the sake of clarity.

FIG. 2 shows an embodiment of an assembly comprising a plurality of thermal heads according to the present invention. A plurality of thermal heads is arranged in staggered fashion in two rows as described above. The diameter of the drum 15 is D. The substrates 17', 17" of the thermal heads of the two rows are mounted at an angle Θ to one another.

Figure 3:
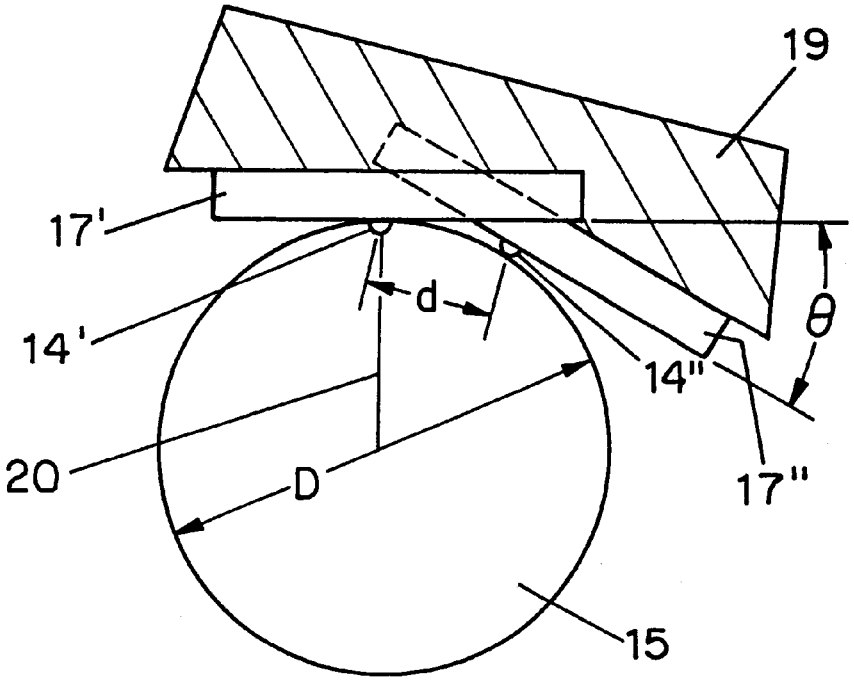
FIG. 3 shows a side view of another embodiment of an assembly comprising a plurality of thermal heads for a wide format printer according to the present invention, from which the thermographic recording material has been omitted for the sake of clarity.

FIG. 3 shows a further embodiment of an improved assembly comprising a plurality of thermal heads according to the present invention. A plurality of thermal heads is arranged in staggered fashion in two rows as described above. The diameter of the drum 15 is D. The substrates 17', 17" of the thermal heads of the two rows are mounted at an angle Θ to one another. Both rows of substrates are mounted on a common support 19,e.g. a heat sink. The contacting wall of support 19 may be machined to accommodate the thermal heads as shown as may also be the substrates of the thermal heads themselves so as to obtain the desired placement.

The relative angular position of the two rows of thermal heads as represented in FIGS. 2 and 3 has, for the sake of clarity, been deliberately exaggerated over that employed in practice according to the present invention. It will be understood that in practice according to the present invention, the angle Θ may be much smaller than shown, practical values being comprised between approximately 0.03 degrees and approximately 20 degrees. The distance d has been represented in FIGS. 2 and 3 as the linear distance between the linear arrays of resistors of the two rows of thermal heads. The line representing this distance in these figures is not normal to the radius of the drum passing through either one of these rows and thus the formula defining the notion arc sine is theoretically incorrect since d is not truly normal to such radii. However, the angles concerned are so small that in practice the distance d equals the normal projection of one row onto the radius of the other row and therefore the above-mentioned definition is used for ease of description.

The radius 20 of the drum 15 passing through array of linear resistors 14' or array of linear resistors 14" may be normal to the respective substrates 17' or 17", but may also differ very slightly from normal to the respective substrate. The improved assembly comprising a plurality of thermal heads improves the thermal contact thereof with a thermographic recording material thereby ensuring that direct thermal printing will produce a uniform print density and image hue without pinholes over the full width of the image.

Thermographic Recording Material

According to the present invention, a thermographic recording material comprises a material or set of materials necessary for image formation. In one embodiment thereof the thermographic recording material comprises a donor ribbon comprising a sublimable dye layer and a receiving layer for the sublimable dye. In another embodiment thereof it comprises a donor ribbon and a receiving layer, the donor ribbon comprising a component which under the influence of heat is transferred to the receiving layer and undergoes a colour-forming reaction with a component thereof. For example the donor ribbon might contain a toning agent and/or one or more reducing agents and the receiving layer might contain a reducible silver source.

In a still further embodiment thereof it is a thermographic recording material comprising a support and at least one thermosensitive element.

Thermosensitive Element

The thermosensitive element, according to the present invention which under the influence of imagewise heating forms an image either in the element itself or after peeling off a material delaminated during the imagewise heating. The element may comprise a layer system and any active ingredients may be present in different layers although in thermal working relationship with one another during the thermal development process.

Such thermosensitive elements may, for example, comprise leuco dyes with acid-releasing ingredients, substantially light-insensitive reducible silver sources and reducing agents therefor in thermal working relationship therewith or delaminatable pigment layers. In a particular embodiment of the present invention the element comprises a substantially light-insensitive reducible silver source, a reducing agent therefor in thermal working relationship therewith and a binder.

Reducible Silver Sources

Preferred substantially light-insensitive reducible silver sources according to the present invention are organic silver salts. Preferred organic silver salts, according to the present invention, are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, with silver behenate being particularly preferred. Such silver salts are also called "silver soaps". In addition silver dodecyl sulphonate described in U.S. Pat. No. 4,504,575; and silver di-(2-ethylhexyl)-sulfosuccinate described in EP-A 227 141, modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

Reducing Agents

Suitable organic reducing agents for the reduction of the substantially light-insensitive organic heavy metal salts are organic compounds containing at least one active hydrogen atom linked to O, N or C, such as is the case with, aromatic di- and tri-hydroxy compounds; aminophenols; METOL (tradename); p-phenylene-diamines; alkoxynaphthols, e.g. 4-methoxy-1-naphthol described in U.S. Pat. No. 3,094,41; pyrazolidin-3-one type reducing agents, e.g. PHENIDONE (tradename); pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

Among useful aromatic di- and tri-hydroxy compounds having at least two hydroxy groups in ortho- or para-position on the same aromatic nucleus, e.g. benzene nucleus, hydroquinone and substituted hydroquinones, catechol, pyrogallol, gallic acid and gallic acid esters are preferred. Particularly useful are polyhydroxy spiro-bis-indane compounds, especially these corresponding to the following general formula (I):

(I)

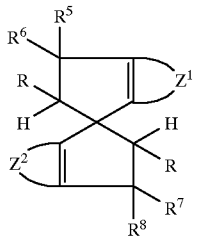

wherein :R represents hydrogen or alkyl, e.g.methyl or ethyl; each of $R^5$ and $R^6$ (same or different) represents an alkyl group, preferably methyl group or a cycloalkyl group, e.g. cyclohexyl group; each of $R^7$ and $R^8$ (same or different) represents, an alkyl group, preferably methyl group or a cycloalkyl group, e.g. cyclohexyl group, and each of $Z^1$ and $Z^2$ (same or different) represents the atoms necessary to close an aromatic ring or ring system, e.g. benzene ring, substituted with at least two hydroxyl groups in ortho- or para-position and optionally further substituted with at least one hydrocarbon group, e.g an alkyl or aryl group.

Particularly preferred catechol-type reducing agents, disclosed in EP-A 692 733, are benzene compounds in which the benzene nucleus is substituted by no more than two hydroxy groups which are present in 3,4-position on the nucleus and have in the 1-position of the nucleus a substituent linked to the nucleus by means of a carbonyl group e.g. 3,4-dihydroxybenzoic acid esters such as ethyl and butyl 3,4-dihydroxybenzoate.

In a preferred embodiment of the present invention, the reducing agent is selected from the group consisting of gallic acid, gallic acid esters, 3,4-dihydroxybenzoic acid and 3,4-dihydroxybenzoic acid esters.

Auxiliary Reducing Agents

The above mentioned reducing agents being considered as primary or main reducing agents may be used in conjunction with so-called auxiliary reducing agents. Such auxiliary reducing agents are e.g. sterically hindered phenols, that on heating become reactive partners in the reduction of the substantially light-insensitive organic heavy metal salt such as silver behenate, such as described in U.S. Pat. No. 4,001,026;or are bisphenols, e.g. of the type described in U.S. Pat. No. 3,547,648. The auxiliary reducing agents may be present in the imaging layer or in a polymeric binder layer in thermal working relationship thereto.

Preferred auxiliary reducing agents are sulfonamidophenols corresponding to the following general formula:

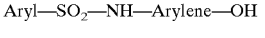

Aryl—$SO_2$—NH—Arylene—OH in which:

Aryl represents a monovalent aromatic group, and

Arylene represents a bivalent aromatic group, having the —OH group preferably in para-position to the —$SO_2$—NH— group.

Film-Forming Binders of The Thermosensitive Element

The film-forming binder of the thermosensitive element containing the substantially light-insensitive reducible silver source may be all kinds of natural, modified natural or synthetic resins or mixtures of such resins, wherein the organic heavy metal salt can be dispersed homogeneously: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

The above mentioned binders or mixtures thereof may be used in conjunction with waxes or "heat solvents" also called "thermal solvents" or "thermosolvents" improving the reaction speed of the redox-reaction at elevated temperature.

By the term "heat solvent"to in this invention is meant a non-hydrolyzable organic material which is in solid state in the recording layer at temperatures below 500° C. but becomes a plasticizer for the recording layer in the heated region and/or liquid solvent for at least one of the redox-reactants, e.g. the reducing agent for the organic heavy metal salt, at a temperature above 600° C.

Toning Agents

In order to obtain a neutral black image tone in the higher densities and neutral grey in the lower densities the recording layer contains preferably in admixture with the organic heavy metal salts and reducing agents a so-called toning agent known from thermography or photo-thermography.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type within the scope of following general formula:

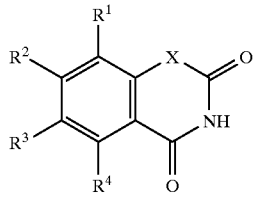

in which:

X represents O or N-alkyl;

each of $R^1$, $R^2$, $R^3$ and $R^4$ (same or different) represents hydrogen, alkyl, e.g. C1–C20 alkyl, preferably C1–C4 alkyl, cycloalkyl, e.g. cyclopentyl or cyclohexyl, alkoxy, preferably methoxy or ethoxy, alkylthio with preferably up to 2 carbon atoms, hydroxy, dialkylamino of which the alkyl groups have preferably up to 2 carbon atoms or halogen, preferably chlorine or bromine; or $R^1$ and $R^2$ or $R^2$ and $R^3$ represent the ring members required to complete a fused aromatic ring, preferably a benzene ring, or $R^3$ and $R^4$ represent the ring members required to complete a fused aromatic aromatic or cyclohexane ring. Toners within the scope of the general formula are described in GB-P 1,439,478 and U.S. Pat. No. 3,951,660.

A toner compound particularly suited for use in combination with polyhydroxy benzene reducing agents is 3,4-dihydro-2,4-dioxo-1,3,2H-benzoxazine described in U.S. Pat. No. 3,951,660.

Other Ingredients

The recording layer may contain in addition to the ingredients mentioned above other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILONE Ö1 A (tradename of BAYER AG—GERMANY), ultraviolet light absorbing compounds, white light reflecting and/or ultraviolet radiation reflecting pigments, silica, and/or optical brightening agents.

Support

The support for the thermal imaging material according to the present invention may be transparent, translucent or opaque, e.g. having a white light reflecting aspect and is preferably a thin transparent resin film, e.g. made of a cellulose ester, polypropylene, polycarbonate or polyester, e.g. polyethylene terephthalate. In a preferred embodiment of the present invention, the support is transparent.

The support may be in sheet, ribbon or web form and subbed if need be to improve the adherence to the thereon coated thermosensitive recording layer. The support may be made of an opacified resin composition, e.g. polyethylene terephthalate opacified by means of pigments and/or microvoids and/or coated with an opaque pigment-binder layer, and may be called synthetic paper, or paperlike film; information about such supports can be found in EP's 194 106 and 234 563 and U.S. Pat. Nos. 3,944,699, 4,187,113, 4,780,402 and 5,059,579. Should a transparent base be used, the base may be colourless or coloured, e.g. having a blue colour.

Outermost Layer in Contact With The Plurality of Thermal Heads

The outermost layer in contact with the plurality of thermal heads may in different embodiments of the present invention be the outermost layer of the thermosensitive element, a protective layer applied to the thermosensitive element or a layer on the opposite side of the support to the thermosensitive element.

A maximum dynamic frictional coefficient between the plurality of thermal heads and the outermost layer in contact with the plurality of thermal heads of less than 0.3 can be attained by one skilled in the art by a combination of one or more matting agents, as described in WO 94/11198 with one or more thermomeltable particles optionally with one or more lubricants, as described in WO 94/11199, or with at least one solid lubricant having a melting point below 150° C. and at least one liquid lubricant in a binder, wherein at least one of the lubricants is a phosphoric acid derivative, as described in EP-A 775 592.

Protective Layer

The outermost layer of the thermographic recording material on the same side of the support as the thermosensitive element, according to the present invention, may be a protective layer applied to the thermosensitive element to avoid local deformation of the thermosensitive element and to improve resistance against abrasion.

Such protective layers may also comprise particulate material, e.g. talc particles, optionally protruding from the protective outermost layer as described in WO 94/11198. Other additives can also be incorporated in the protective layer e.g. colloidal particles such as colloidal silica.

Hydrophilic Binder For Outermost Layer

According to an embodiment of the present invention the outermost layer of the recording material in contact with the plurality of thermal heads may comprise a hydrophilic binder. Suitable hydrophilic binders for the outermost layer in contact with the plurality of thermal heads are, for example, gelatin, polyvinylalcohol, cellulose derivatives or other polysaccharides, hydroxyethylcellulose, hydroxypropylcellulose etc., with hardenable binders being preferred and polyvinylalcohol being particularly preferred.

Crosslinking Agents For Outermost Layer

According to an embodiment of the present invention the outermost layer of the recording material in contact with the plurality of thermal heads may be crosslinked. Crosslinking can be achieved by using crosslinking agents such as described in WO 95/12495 for protective layers, e.g. tetraalkoxysilanes, polyisocyanates, zirconates, titanates, melamine resins etc., with tetraalkoxysilanes such as tetramethylorthosilicate and tetraethylorthosilicate being preferred.

Matting Agents For Outermost Layer

The outermost layer of the recording material in contact with the plurality of thermal heads according to the present invention may comprise a matting agent. Suitable matting agents are described in WO 94/11198 and include e.g. talc particles and optionally protrude from the outermost layer.

Lubricants For Outermost Layer

The outermost layer of the recording material according to the present invention may comprise at least one lubricant. Examples of suitable lubricating materials are surface active agents, liquid lubricants, solid lubricants which do not melt during thermal development of the recording material, solid lubricants which melt (thermomeltable) during thermal development of the recording material or mixtures thereof.

The lubricant is preferably selected from a group consisting of silicon derivatives, polyolefins, fatty acid derivatives, fatty alcohol derivatives and phosphoric acid derivatives.

Antistatic Layer

In a preferred embodiment the recording material of the present invention an antistatic layer is applied to the outermost layer thereof which is not in contact with the plurality of thermal heads during the thermal image forming process. Suitable antistatic layers therefor are described in EP-A 440 957, U.S. Pat. No. 5,312,681 and U.S. Pat. No. 5,354,613, with those described in U.S. Pat. No. 5,354,613 being preferred.

Coating

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Processing Assemblies

As described in "Handbook of Imaging Materials", edited by Arthur S. Diamond—Diamond Research Corporation—

Ventura, Calif., printed by Marcel Dekker, Inc. 270 Madison Avenue, New York, N.Y. 10016 (1991), p. 498–502 in thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. The operating temperature of common thermal printheads is in the range of 300 to 400° C. and the heating time per picture element (pixel) may be 50 ms or less, the pressure contact of the thermal printhead with the recording material being e.g. 100–500 g/cm of linear array of resistor elements to ensure a good transfer of heat.

In a particular embodiment of the method according to the present invention the direct thermal image-wise heating of the recording material proceeds by Joule effect heating in that selectively energized electrical resistors of a thermal head array are used in contact or close proximity with the recording layer. The image signals for modulating the current in the micro-resistors of a thermal printhead are obtained directly e.g. from opto-electronic scanning devices or from an intermediary storage means, e.g. magnetic disc or tape or optical disc storage medium, optionally linked to a digital image work station wherein the image information can be processed to satisfy particular needs.

In an embodiment of the present invention, the direct thermal printing process comprises the steps of: (i) feeding the above described thermographic recording material onto a drum of diameter D mm; and (ii) image-wise heating the thermographic recording material using the above described assembly comprising a plurality of thermal heads.

In a further embodiment of the direct thermal printing process, according to the present invention, a pressure of at least 100 g per cm of linear array of resistor elements is applied between the thermographic recording material and the plurality of thermal heads.

According to EP-A 622 217 relating to a method for making an image using a direct thermal imaging element, improvements in continuous tone reproduction are obtained by heating the thermal thermographic recording material by means of a thermal head having a plurality of heating elements, characterized in that the activation of the heating elements is executed line by line with a duty cycle Δ representing the ratio of activation time to total line time in such a way that the following equation is satisfied:

$$P \leq P_{max} = 3.3 W/mm^2 + (9.5 W/mm^2 \times \Delta)$$

wherein $P_{max}$ is the maximal value over all the heating elements of the time averaged power density P (expressed in $W/mm^2$) dissipated by a heating element during a line time.

Direct thermal imaging and can be used for both the production of transparencies and reflection type prints. In the hard copy field recording materials on a white opaque base are used. Black-imaged transparencies with transparent bases are used in both the graphics and medical diagnostic fields. In the graphics field dots and lines are printed using thermographic recording materials with a hard gradation and the transparencies are used as masks in the exposure of photosensitive compositions on printing plate bases in the process of printing plate preparation. In the medical diagnostic field black-imaged transparencies are widely used in inspection techniques operating with a light box.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appending claims. A thermographic recording material is described below which is suitable for use with the assembly comprising a plurality of thermal heads of the present invention.

PREPARATION OF A THERMOGRAPHIC RECORDING MATERIAL USABLE WITH THE ASSEMBLY COMPRISING A PLURALITY OF THERMAL HEADS OF THE PRESENT INVENTION

Thermosensitive Element

A subbed polyethylene terephthalate support having a thickness of 100 μm was doctor blade-coated with a coating composition containing butanone as a solvent and the following ingredients so as to obtain thereon, after drying for 1 hour at 50° C., a layer containing:

silver bDehenate: 6.4 $g/m^2$ polyvinylbutyral (Butvar® B79 from Monsanto): 6.47 $g/m^2$ silicone oil (Baysilone® MA from Bayer AG): 0.024 $g/m^2$ 7-(ethylcarbonato)-benzo [e][1,3]oxazine-2,4-dione dione, a toning agent (see formula II below): 0.718 $g/m^2$ ethyl 3,4-dihydroxybenzoate, a reducing agent: 1.309$g/m^2$ tetrachlorophthalic anhydride: 0.154 $g/m^2$ 1-(3-decanoylaminophenyl)-1H-tetrazole-5-thiol: 0.13 $g/m^2$

II)

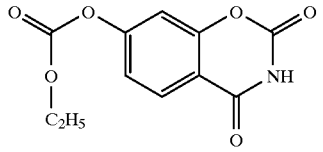

Coating of Thermosensitive Element With a Surface Protective Layer

The thermosensitive element was then coated with an aqueous composition with the following composition expressed as weight percentages of ingredients present:

polyvinylalcohol (Mowiviol® WX 48 20 from Wacker Chemie): 2.5%

Ultravon® W (dispersion agent from Ciba Geigy) converted into acid form by passing through an ion exchange column: 0.09% talc (type P3 from Nippon Talc): 0.05% colloidal silica (Levasil® VP AC 4055 from Bayer AG, a 15% aqueous dispersion of colloidal silica): 1.2% silica (Syloid® 72 from Grace): 0.10% mono[isotridecyl polyglycolether (3 EO)] phosphate (Servoxyl® VPDZ 3/100 from Servo Delden B.V.): 0.09% mixture of monolauryl and dilauryl phosphate (Servoxyl® VPAZ 100 from Servo Delden B.V.): 0.09% glycerine monotallow acid ester (Rilanit® GMS from Henkel AG): 0.18% tetramethylorthosilicate hydrolyzed in the presence of methanesulfonic acid: 2.1%

The pH of the coating composition was adjusted to a pH of 3.8 by adding 1N nitric acid. Those lubricants in these compositions which were insoluble in water, were dispersed in a ball mill with, if necessary, the aid of a dispersion agent. The compositions were coated to a wet layer thickness of 85

μm and were then dried at 40° C. for 15 minutes and hardened at 45° C.

Thermographic Printing

A CALCOMP® ECOGRAPHICS PLOTTER is a wide format printer with a state of the art 91.4 cm (36 inch) assembly comprising a plurality of thermal heads and a drum for the mounting of a thermographic recording material of diameter 3.40 cm. The plurality of thermal heads is composed of 3 thermal heads, the ceramic substrates of which are mounted on an aluminium base which acts as the heat sink. The middle thermal head in this plurality of thermal heads is shifted lmm horizontally with respect to the two outer thermal heads and therefore with an angle Θ of 0° falls outside the present invention.

Printing solid blacks using the above described thermographic recording material in combination with this printer with the assembly comprising a plurality of thermal heads in its standard setting produced prints with pinholes and damage to both the thermosensitive element and the protective layer of the thermographic recording material in the area of the solid black corresponding to middle thermal head in the plurality of thermal heads of the printer. Adjustment of the position assembly comprising a the plurality of thermal heads to avoid damage to the thermographic recording material in the area of the image corresponding to the middle thermal head resulted in an improved image quality in the area of the image corresponding to the middle thermal head, but with pinholes in those areas of the image corresponding to the two outer thermal heads. It proved impossible to obtain a uniform print density and image hue without pinholes over the full width of the image, i.e. over the full length of the plurality of thermal heads, with this prior art assembly comprising a plurality of thermal heads.

This variation in print density and image hue together with the presence of pinholes in the image are due to non-uniform thermal contact between the state of the art assembly comprising a plurality of thermal heads and the thermographic recording material supported on a drum. The assembly comprising a plurality of thermal heads of the present invention ensures uniform thermal contact between the plurality of thermal heads and a thermographic recording material supported on a drum and thereby uniform print density, uniform image hue and an absence of pinholes.

Having described in detail preferred embodiments of the current invention, it will now be apparent to those skilled in the art that numerous modifications can be made therein without departing from the scope of the invention as defined in the following claims.

I claim:

1. An assembly comprising:

a plurality of thermal heads, each thermal head in turn comprising a linear array of resistor elements mounted on a flat substrate, and a drum of diameter D mm for supporting a thermographic recording material, said thermal heads being mounted in a staggered fashion in at least two parallel rows in which the linear arrays of resistor elements are parallel to one another, wherein:

(i) said resistor arrays of adjacent rows of thermal heads are separated by a spacing, d, greater than 0.2 mm;

(ii) said substrates of thermal heads in adjacent rows include an angle Θ comprised between arc sine (d/2D) and arc sine (2d/D);

(iii) said angle Θ is ≦20°;

(iv) said substrates of said rows of thermal heads are mounted on a common base; and (v) said substrates being arranged with respect to the drum such that a radius of the drum passing through a given one of said array of resistor elements is normal to a corresponding one of said substrates.

2. A direct thermal printing process comprising the steps of:

(i) feeding a thermographic recording material onto a drum of diameter D mm; and (ii) image-wise heating said thermographic recording material using an assembly comprising:

a plurality of thermal heads, each thermal head in turn comprising a linear array of resistor elements mounted on a flat substrate, and said drum of said diameter D mm for supporting said thermographic recording material, said thermal heads being mounted in a staggered fashion in at least two parallel rows in which the linear arrays of resistor elements are parallel to one another, wherein:

(i) said resistor arrays of adjacent rows of thermal heads are separated by a spacing, d, greater than 0.2 mm;

(ii) said substrates of thermal heads in adjacent rows include an angle Θ comprised between arc sine (d/2D) and arc sine (2d/D) ; and (iii) said angzle Θ is ≦20°.

3. A direct thermal printing process according to claim 2, wherein step (i) comprises feeding said thermographic recording material as a donor ribbon comprising a sublimable dye layer and a receiving layer for said sublimable dye.

4. A direct thermal printing process according to claim 2, wherein step (i) comprises feeding said thermographic recording material as a donor ribbon and a receiving layer, said donor ribbon comprising a component which under the influence of heat is transferred to said receiving layer and undergoes a colour-forming reaction with a component thereof.

5. A direct thermal printing process according to claim 2, wherein step (i) comprises feeding said thermographic recording material as a support and at least one thermosensitive element.

6. A direct thermal printing process according to claim 5, wherein step (i) comprises feeding said thermosensitive element as a substantially light-insensitive reducible silver source, a reducing agent therefor in thermal working relationship therewith and a binder.

7. A direct thermal printing process according to claim 6, wherein step (i) comprises feeding said substantially light-insensitive reducible silver source as an organic silver salt.

8. A direct thermal printing process according to claim 6, wherein step (i) includes selecting said reducing agent from the group consisting of gallic acid, gallic acid esters, 3,4-dihydroxybenzoic acid and 3,4-dihydroxybenzoic acid esters.

9. A direct thermal printing process according to claim 2, wherein said drum is transparent, such that step (i) comprises feeding said recording material onto said transparent drum.

10. A direct thermal printing process according to claim 2, further comprising the additional step of applying a pressure of at least 100 g per cm of linear array of resistor elements between said thermographic recording material and said thermal head assembly.

* * * * *